US012538974B2

(12) United States Patent
Hall

(10) Patent No.: US 12,538,974 B2
(45) Date of Patent: Feb. 3, 2026

(54) GYM BAG DEVICE

(71) Applicant: Linneth Hall, Valley Stream, NY (US)

(72) Inventor: Linneth Hall, Valley Stream, NY (US)

( * ) Notice: Subject to any disclaimer, the term of this patent is extended or adjusted under 35 U.S.C. 154(b) by 93 days.

(21) Appl. No.: 18/440,568

(22) Filed: Feb. 13, 2024

(65) Prior Publication Data

US 2025/0255400 A1 Aug. 14, 2025

(51) Int. Cl.
*A45F 3/04* (2006.01)
*A45F 3/00* (2006.01)

(52) U.S. Cl.
CPC ..... *A45F 3/04* (2013.01); *A45F 2003/003* (2013.01)

(58) Field of Classification Search
CPC ..... A45F 3/04
See application file for complete search history.

(56) References Cited

U.S. PATENT DOCUMENTS

| | | | | |
|---|---|---|---|---|
| 3,019,952 | A * | 2/1962 | Brewster | A45C 3/00 294/142 |
| 4,790,463 | A * | 12/1988 | Hansen | A45F 3/04 383/3 |
| 4,984,662 | A * | 1/1991 | Jacober | A45C 7/0077 190/125 |
| 5,022,574 | A * | 6/1991 | Cesari | A45C 5/14 224/580 |
| 5,950,894 | A * | 9/1999 | Haber | A45F 3/04 224/580 |
| 7,510,104 | B2 | 3/2009 | Taylor | |
| D835,397 | S * | 12/2018 | Kawamoto | D3/217 |
| 11,110,307 | B1 * | 9/2021 | Possible | A62B 25/00 |
| D983,517 | S | 4/2023 | Chen | |
| 12,240,568 | B2 * | 3/2025 | Steevens | A45F 3/14 |
| 2006/0043135 | A1 | 3/2006 | Lindsey | |
| 2017/0036844 | A1 * | 2/2017 | Seiders | A45C 13/008 |
| 2018/0279728 | A1 * | 10/2018 | Marrello | A45C 13/30 |
| 2020/0037733 | A1 | 2/2020 | Lee | |
| 2020/0170385 | A1 | 6/2020 | Mallard | |
| 2021/0145137 | A1 | 5/2021 | Williams | |
| 2021/0345740 | A1 * | 11/2021 | Seiders | A45C 3/04 |

FOREIGN PATENT DOCUMENTS

| | | | | |
|---|---|---|---|---|
| CN | 111297036 A * | 6/2020 | | A45C 9/00 |
| WO | WO2019006501 | 1/2019 | | |

* cited by examiner

*Primary Examiner* — Scott T McNurlen

(57) ABSTRACT

A gym bag device for conveniently carrying all gym essentials in a single bag includes a container having a base side and a peripheral side that is coupled to and extends upwardly from the base side. The peripheral side has a front side, a back side, and a pair of lateral sides. A plate is coupled to the base side of the container to retain the base side in a circular shape. A front pocket is coupled to the front side of the container. A back pocket coupled to the back side of the container is cylindrical for holding a rolled-up yoga mat. A plurality of side pockets is coupled to the pair of lateral sides of the container. A plurality of straps is coupled to the container. Each strap of the plurality of straps is configured to facilitate a user in carrying the container.

11 Claims, 8 Drawing Sheets

GYM BAG DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to gym bags and more particularly pertains to a new gym bag for conveniently carrying all gym essentials in a single bag.

(2) Description of Related Art Including Information Disclosed Under 37 CFR 1.97 and 1.98

The prior art relates to gym bags. Fitness enthusiasts often use a bag to carry their headphones, towels, water bottles, yoga mats, and other supplies through the gym during an exercise session. Some people may use a duffle bag, with out without wheels, particularly when that person has numerous items to carry through the gym. For example, a person may want to carry a change of clothes and other supplies for cleaning up after the exercise session, along with all of the items the person needs while exercising. Typically, people will use duffle bags, backpacks, or even suitcases that are designed for travel. Such bags can be difficult to organize for an exercise session. Such bags can also provide insufficient storage space. For example, such bags often do not fit a yoga mat, along with all of the other supplies needed. Thus, there is a need in the art for a gym bag that can be used to carry and organize all fitness essentials, including a yoga mat, a water bottle, headphones, a cellular telephone, and a change of clothes.

BRIEF SUMMARY OF THE INVENTION

An embodiment of the disclosure meets the needs presented above by generally comprising a container having a base side and a peripheral side that is coupled to and extends upwardly from the base side. The peripheral side has an upper edge. The upper edge defines an upper opening extending into the container. The peripheral side has a front side, a back side, and a pair of lateral sides that is coupled to and extends between the front side and the back side. The base side has a circular shape. A plate is coupled to an exterior surface of the base side of the container. The plate comprises a rigid material wherein the plate is configured to retain the base side in the circular shape. A front pocket is coupled to the front side of the container. A back pocket is coupled to the back side of the container. The back pocket is cylindrical wherein the back pocket is configured to hold a rolled-up yoga mat. A plurality of side pockets is coupled to the pair of lateral sides of the container. A plurality of straps is coupled to the container. Each strap of the plurality of straps is configured to facilitate a user in carrying the container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
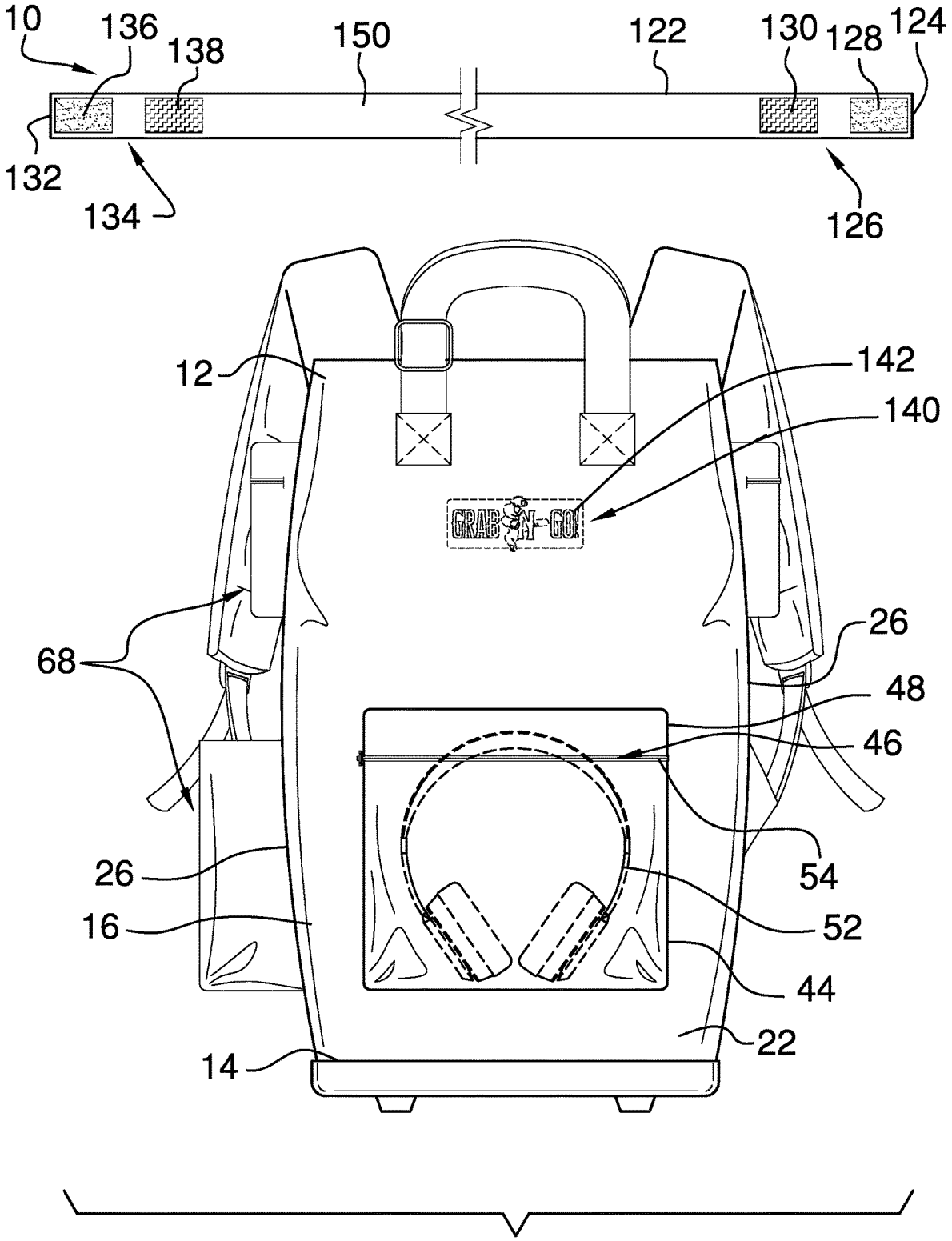
FIG. 1 is a front view of a gym bag device according to an embodiment of the disclosure.
Figure 2:
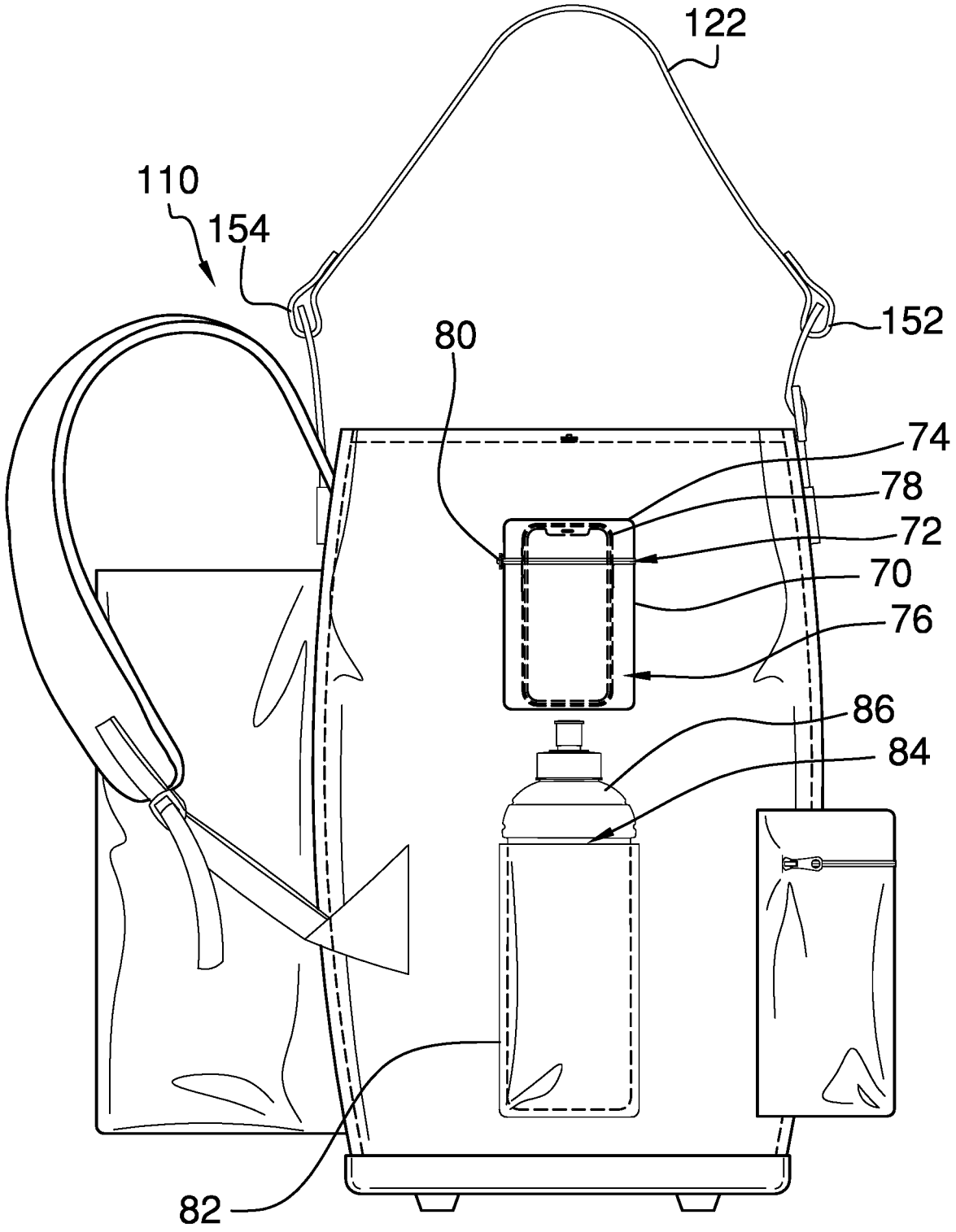
FIG. 2 is a side view of an embodiment of the disclosure.
Figure 3:
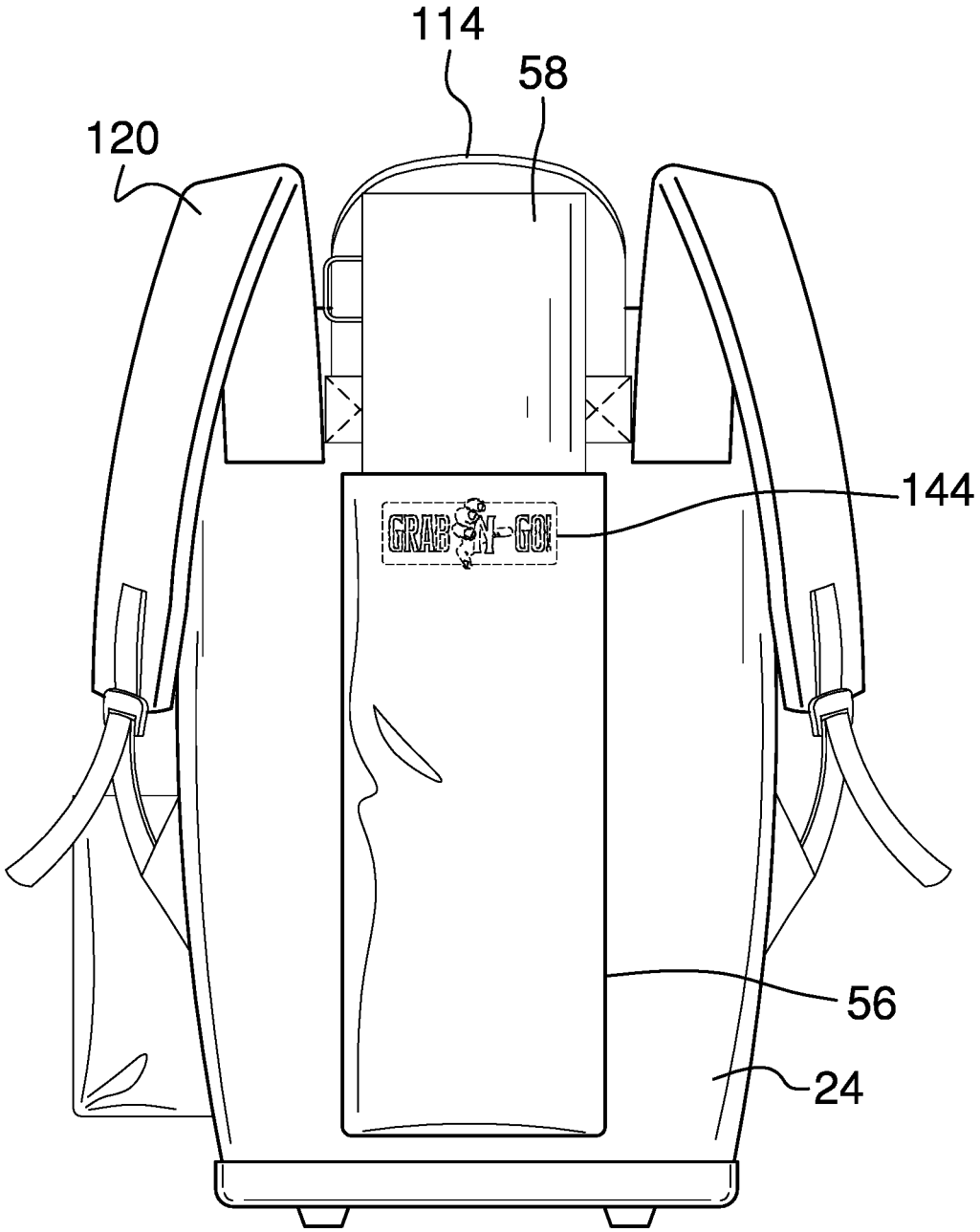
FIG. 3 is a back view of an embodiment of the disclosure.
Figure 4:
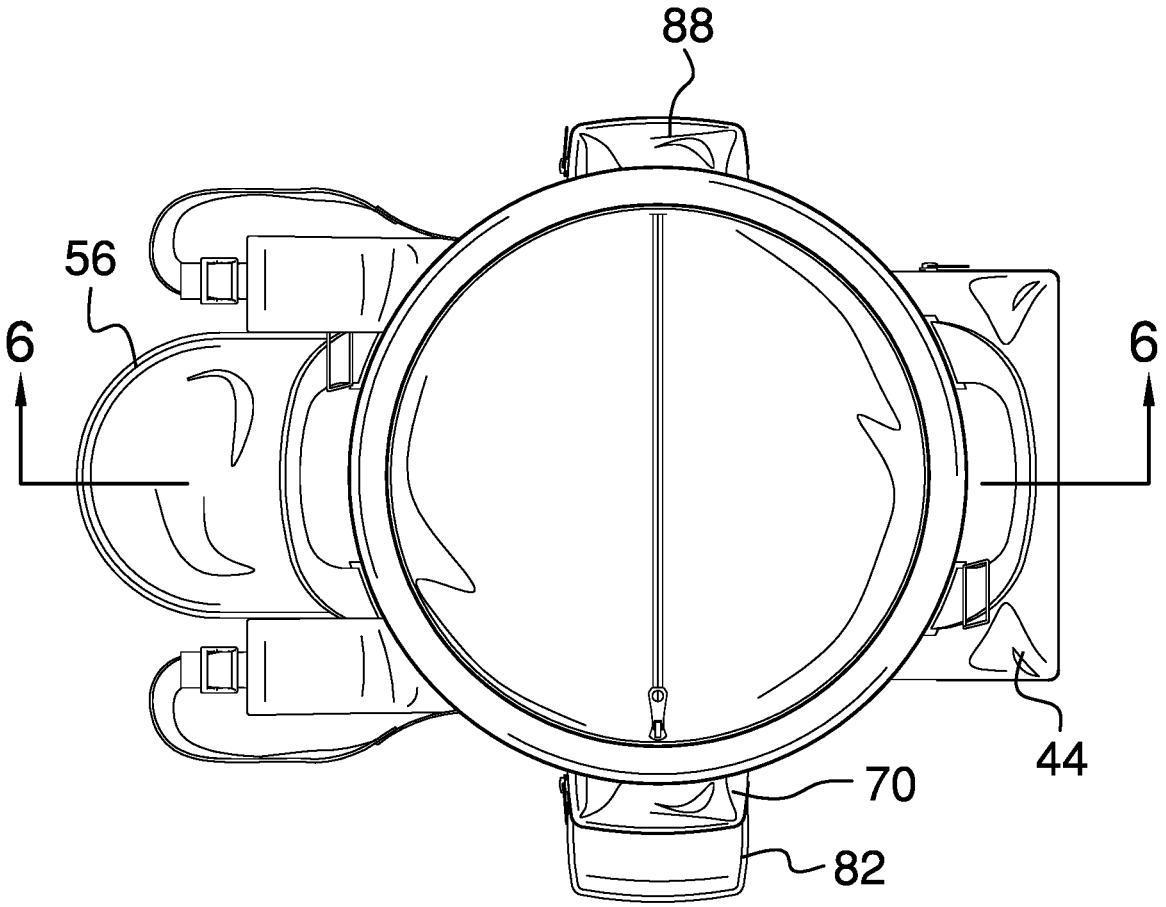
FIG. 4 is a top view of an embodiment of the disclosure.
Figure 5:
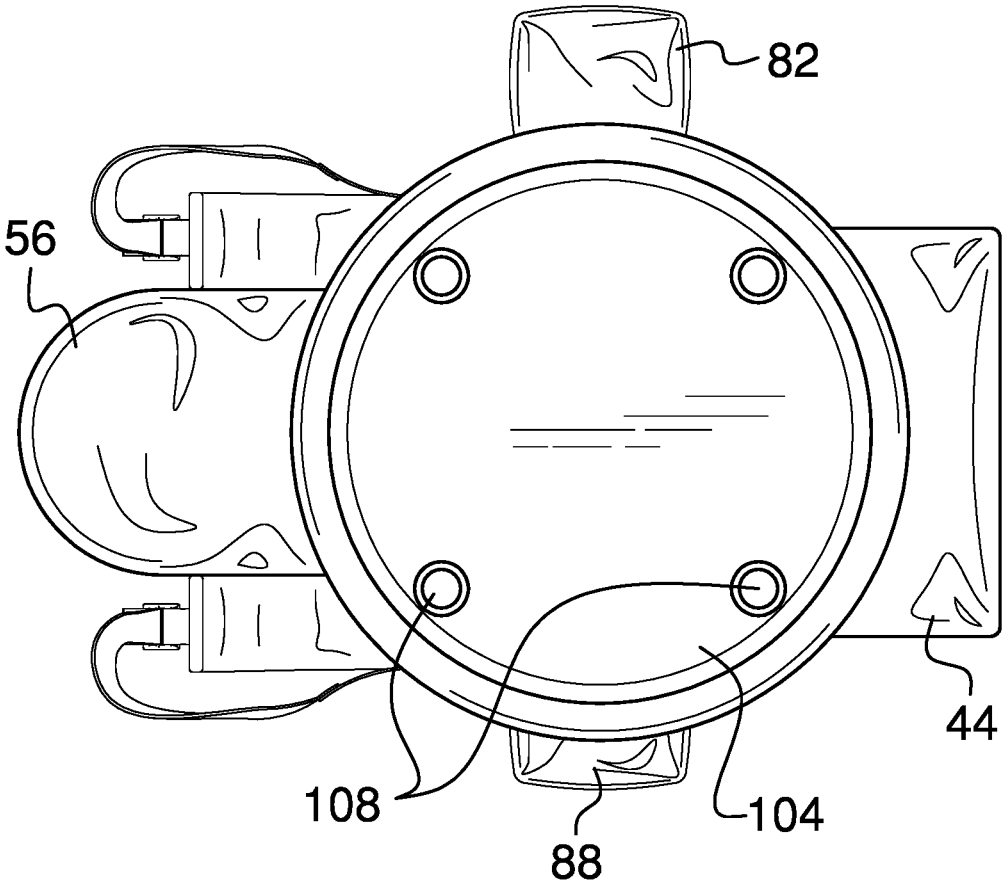
FIG. 5 is a bottom view of an embodiment of the disclosure.
Figure 6:
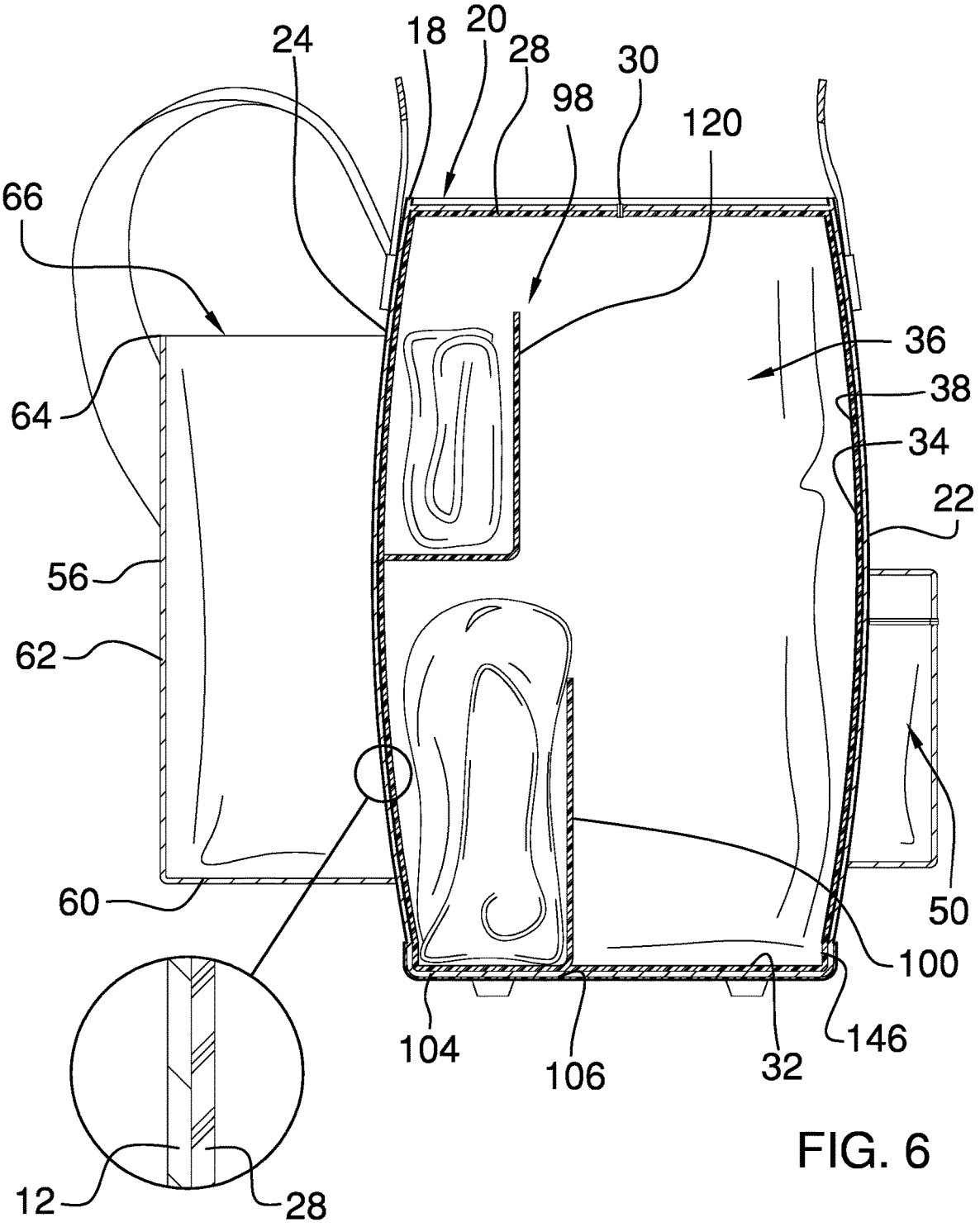
FIG. 6 is a cross-sectional view of an embodiment of the disclosure.

With reference now to the drawings, and in particular to FIGS. 1 through 8 thereof, a new gym bag embodying the principles and concepts of an embodiment of the disclosure and generally designated by the reference numeral 10 will be described.

As best illustrated in FIGS. 1 through 8, the gym bag device 10 generally comprises a container 12 that has a base side 14 and a peripheral side 16 that is coupled to and extends upwardly from the base side 14. The peripheral side 16 includes an upper edge 18. The upper edge 18 defines an upper opening 20 extending into the container 12. The peripheral side 16 generally has a front side 22, a back side 24, and a pair of lateral sides 26 that is coupled to and extends between the front side 22 and the back side 24. The base side 14 may have a circular shape wherein the container 12 is cylindrical.

A liner 28 has a top wall 30, a bottom wall 32, and a perimeter wall 34 that extends upwardly from a perimeter edge 146 of the bottom wall 32 to the top wall 30 to define an interior space 36 of the liner 28. The liner 28 may be coupled to and coextensive with an inside surface 38 of the container 12. The liner 28 may comprise a waterproof material wherein the liner 28 is configured to inhibit the inside surface 38 of the container 12 from absorbing fluids.

The bottom wall 32 of the liner 28 may abut and being coextensive with the base side 14 of the container 12. For example, the bottom wall 32 may be coextensive with an entirety of the base side 14 of the container 12. The top wall 30 generally extends across the upper opening 20 extending into the container 12. The top wall 30 may be openable to facilitate access into the interior space 36 of the liner 28 through the upper opening 20 extending into the container 12. The perimeter wall 34 of the liner 28 may abut and be coextensive with the peripheral side 16 of the container 12. For example, the perimeter wall 34 may extend upwardly relative to the bottom wall 32 wherein the perimeter wall 34 of the liner 28 covers a portion of the peripheral side 16 of the container 12 that extends upwardly from the base side 14.

A slit 40 may extend through the top wall 30 of the liner 28. The slit 40 may be openable to facilitate access to the interior space 36. The slit 40 may extend between the pair of lateral sides 26 of the container. The slit 40 may be spaced equidistantly from each of the front side 22 and the back side 24 of the container 12. A slit fastener 42 may be coupled to the slit 40 for selectively opening and closing the slit 40. For example, the slit fastener 42 may comprising a zipper, although alternative fasteners such as a hook and loop material may also be used.

A front pocket 44 may be coupled to the front side 22 of the container 12. The front pocket 44 may extend outwardly from the front side 22 of the container 12. The front pocket 44 may be positioned proximate to the base side 14 of the container 12. The front pocket 44 may have a front pocket opening 46 that extends into the front pocket 44.

A front pocket lid 48 may be coupled to the front side 22 of the container 12. The front pocket lid 48 may be positioned adjacent to the front pocket opening 46. The front pocket lid 48 is releasably couplable to the front pocket 44 for selectively closing the front pocket opening 46. The front pocket 44 and the front pocket lid 48 generally define a front storage space 50 wherein the front pocket 44 is configured for storing a pair of headphones 52. For example, the pair of headphones 52 may comprise over-the-ear headphones.

A front pocket fastener 54 may releasably couple the front pocket lid 48 to the front pocket 44 for selectively opening and closing the front pocket opening 46. For example, the front pocket fastener 54 may comprise a zipper.

A back pocket 56 may be coupled to the back side 14 of the container 12. The back pocket 56 may extend outwardly from the back side 14 of the container 12. The back pocket 56 may be cylindrical wherein the back pocket 56 is configured to hold a rolled-up yoga mat 58.

Embodiments of the back pocket 56 may further comprise a bottom panel 60 that is coupled to the back side 24 of the container 12. The bottom panel may be positioned proximate to the base side 14. The bottom panel 60 may extend outwardly from the back side 24 of the container 12. A side panel 62 may be coupled to and extend upwardly from the bottom panel 60. The side panel 62 may have a free edge 64 that is spaced from the bottom panel 60. The free edge 64 may be positioned proximate to the upper edge 18 of the peripheral side 16 of the container 12. The free edge 64 may define a back pocket opening 66 that extends into the back pocket 56. The back pocket opening 66 is generally configured to receive the rolled-up yoga mat 58, for example because the back pocket opening 66 is circular.

A plurality of side pockets 68 may be coupled to the pair of lateral sides 26 of the container 12. All or some of the plurality of side pockets 68 may extend outwardly from the pair of lateral sides 26 of the container 12.

The plurality of side pockets 68 may further comprise a cell phone pocket 70 that is coupled to, and may extend outwardly from, a first one of the pair of lateral sides 28. The cell phone pocket 70 may be positioned proximate to the upper edge 18 of the peripheral side 16. The cell phone pocket 70 may have a cell phone pocket opening 72 that extends into the cell phone pocket 70.

A cell phone pocket lid 74 may be coupled to the first one of the pair of lateral sides 26. The cell phone pocket lid 74 may be positioned adjacent to the cell phone pocket opening 72. The cell phone pocket lid 74 is releasably couplable to the cell phone pocket 70 for selectively closing the cell phone pocket opening 72. The cell phone pocket 70 and the cell phone pocket lid 74 may define a cell phone storage space 76 wherein the cell phone pocket 70 is configured for storing a personal electronic device 78, such as a cell phone.

A cell phone pocket fastener 80 may releasably couple the cell phone pocket lid 74 to the cell phone pocket 70 for selectively opening and closing the cell phone pocket opening 72. For example, the cell phone pocket fastener 80 may comprise a zipper.

A water bottle pocket 82 may be coupled to one of the pair of lateral sides 26. For example, the water bottle pocket 82 may be positioned on the first one of the pair of lateral sides 26, where the cell phone pocket 70 is located. The water bottle pocket 82 may extend outwardly from the one of the pair of lateral sides 26 where the water bottle pocket 82 is positioned. The water bottle pocket 82 may have a height exceeding a height of the cell phone pocket 70. The water bottle pocket 82 may have a water bottle pocket opening 84 that extends into the water bottle pocket 82. The water bottle pocket 82 may be positioned beneath the cell phone pocket 70. The water bottle pocket opening 84 may be round wherein the water bottle pocket 82 is configured for storing a water bottle 86.

An accessory pocket 88 may be coupled to the pair of lateral sides 26. For example, the accessory pocket 88 may be positioned on a second one of the pair of lateral sides 26. The second one of the pair of lateral sides 26 generally faces away from the first one of the pair of lateral sides 26. In other words, the second one of the pair of lateral sides 26 is generally on the opposite side of the container 12 from the first one of the pair of lateral sides 26. The accessory pocket 88 may be aligned with the cell phone pocket 70 across the container 12. The accessory pocket 88 may extend outwardly from the one of the pair of lateral sides 26 on which the accessory pocket 88 is positioned. The accessory pocket 88 may have an accessory pocket opening 90 that extends into the accessory pocket 88.

An accessory pocket lid 92 may be coupled to the one of the pair of lateral sides 26 where the accessory pocket 88 is positioned. For example, the accessory pocket lid 92 may be coupled to the second one of the pair of lateral sides 26 of the container. The accessory pocket lid 92 may be positioned adjacent to the accessory pocket opening 90. The accessory pocket lid 92 is releasably couplable to the accessory pocket 88 for selectively closing the accessory pocket opening 90. The accessory pocket 88 and the accessory pocket lid 92 may define an accessory pocket storage space 94 wherein the accessory pocket 88 is configured for storing the personal electronic device 78.

An accessory pocket fastener 96 may releasably couple the accessory pocket lid 92 to the accessory pocket 88 for selectively opening and closing the accessory pocket opening 90. For example, the accessory pocket fastener 96 may comprise a zipper.

A plurality of inner pockets 98 may be coupled to the liner 28. The plurality of inner pockets 98 are generally positioned in the interior space 36 of the liner 28. The plurality of inner pockets may extend outwardly into the interior space 36 of the liner 28.

The plurality of inner pockets 98 may further comprise a lower pocket 100 that is coupled to the bottom wall 32 of the liner 28. The lower pocket 100 may extend upwardly from the bottom wall 32 of the liner 28. The lower pocket 100 may be positioned adjacent to the back side 14 of the container 12.

An upper pocket 102 may be coupled to the perimeter wall 34 of the liner 28. The upper pocket 102 may be aligned with the lower pocket 100 along the back side 14 of the container 12. The upper pocket 102 may be spaced from the lower pocket 100, for example being positioned proximate to the top wall 30 of the liner 28. The lower pocket 100 may have a volume exceeding a volume of the upper pocket 102.

A plate 104 may be coupled to an exterior surface 106 of the base side 14 of the container 12. The plate 104 generally comprises a rigid material that is configured to conform the base side 14 to the circular shape. For example, the rigid material may comprise rubber.

A plurality of feet 108 may be attached to the plate 104. The plurality of feet 108 may extend downwardly from the plate 104 wherein the plurality of feet 108 is configured to support the container 12 over a ground surface 148 when the plurality of feet 108 is resting on the ground surface 148. For example, the plurality of feet 108 may include four feet.

A plurality of straps 110 may be coupled to the container 12. Each strap of the plurality of straps 110 is generally configured to facilitate a user 112 in carrying the container 12.

The plurality of straps 110 may include a pair of handle straps 114 that is coupled to and extends upwardly from the peripheral side 16 of the container 12. The pair of handle straps 114 may be positioned on opposing lateral sides of the peripheral side 16. The pair of handle straps 114 may be positioned adjacent to the upper edge 18 of the peripheral side 16 of the container 12.

The pair of handle straps 114 may further comprise a first handle 116 that is coupled to the front side 22 of the container 12 and a second handle 118 that is coupled to the back side 24 of the container 12. The second handle 118 may be aligned with the first handle 116 across the upper opening 20 of the container 12. Each of the pair of handle straps 114 may have an adjustable length.

A carrying strap 122 may be removably couplable to the pair of handle straps 114. The carrying strap 122 may extend over the upper opening 20 extending into the container 12 when the carrying strap 122 is coupled to the pair of handle straps 114.

The carrying strap 122 may further comprise a first strap end 124 and a second strap end 132. The carrying strap may further comprise an elongated body 150 extending between the first strap end 124 and the second strap end 132. The elongated body 150 may comprise a flexible material or a resiliently compressible material wherein the elongated body 150 of the carrying strap 122 is configured to be foldable.

A first end coupler 126 may be coupled to the first strap end 124. The first end coupler 126 may releasably attach the first strap end 124 to one of the pair of handle straps 114. The first end coupler 126 may further comprise a primary attachment piece 128 that is attached to the first strap end 124. A secondary attachment piece 130 may be removably engageable with the primary attachment piece 128. The secondary attachment piece 130 may be attached to the elongated body 150 of the carrying strap 122 proximate to the primary attachment piece 128. The secondary attachment piece 130 may be spaced from the primary attachment piece 128 wherein the first strap end 124 is configured to fold over the carrying strap 122 to form a first loop 152 for engaging the one of the pair of handle straps 114. Each of the primary attachment piece 128 and the secondary attachment piece 130 may comprise a hook and loop material.

A second end coupler 134 may be coupled to the second strap end 132. The second end coupler 134 may releasably attach the second strap end 132 to one of the pair of handle straps 114. The second end coupler 134 may further comprise an outer attachment piece 136 that is attached to the second strap end 132. An inner attachment piece 138 may be removably engageable with the outer attachment piece 136. The inner attachment piece 138 may be attached to the elongated body 150 of the carrying strap 122 proximate to the outer attachment piece 136. The inner attachment piece 138 may be spaced from the outer attachment piece 136 wherein the second strap end 132 is configured to fold over the carrying strap 122 to form a second loop 154 for engaging the one of the pair of handle straps 114. Each of the inner attachment piece 138 and the outer attachment piece 136 may comprise a hook and loop material.

A pair of shoulder straps 120 may be coupled to the back side 24 of the container 12. The back pocket 56 may be positioned between the pair of shoulder straps 120. Each shoulder strap of the pair of shoulder straps 120 may have an adjustable length.

A plurality of decorative indicia may be positioned on the gym bag device 10. For example, a front logo 142 may be positioned on the front side 22 of the peripheral side 16 of the container 12. In some embodiments, the front logo 142 may be positioned above the front pocket 44. A back logo 144 may be positioned on the back pocket 56 adjacent to the free edge 64 of the side panel 62.

Figure 7:
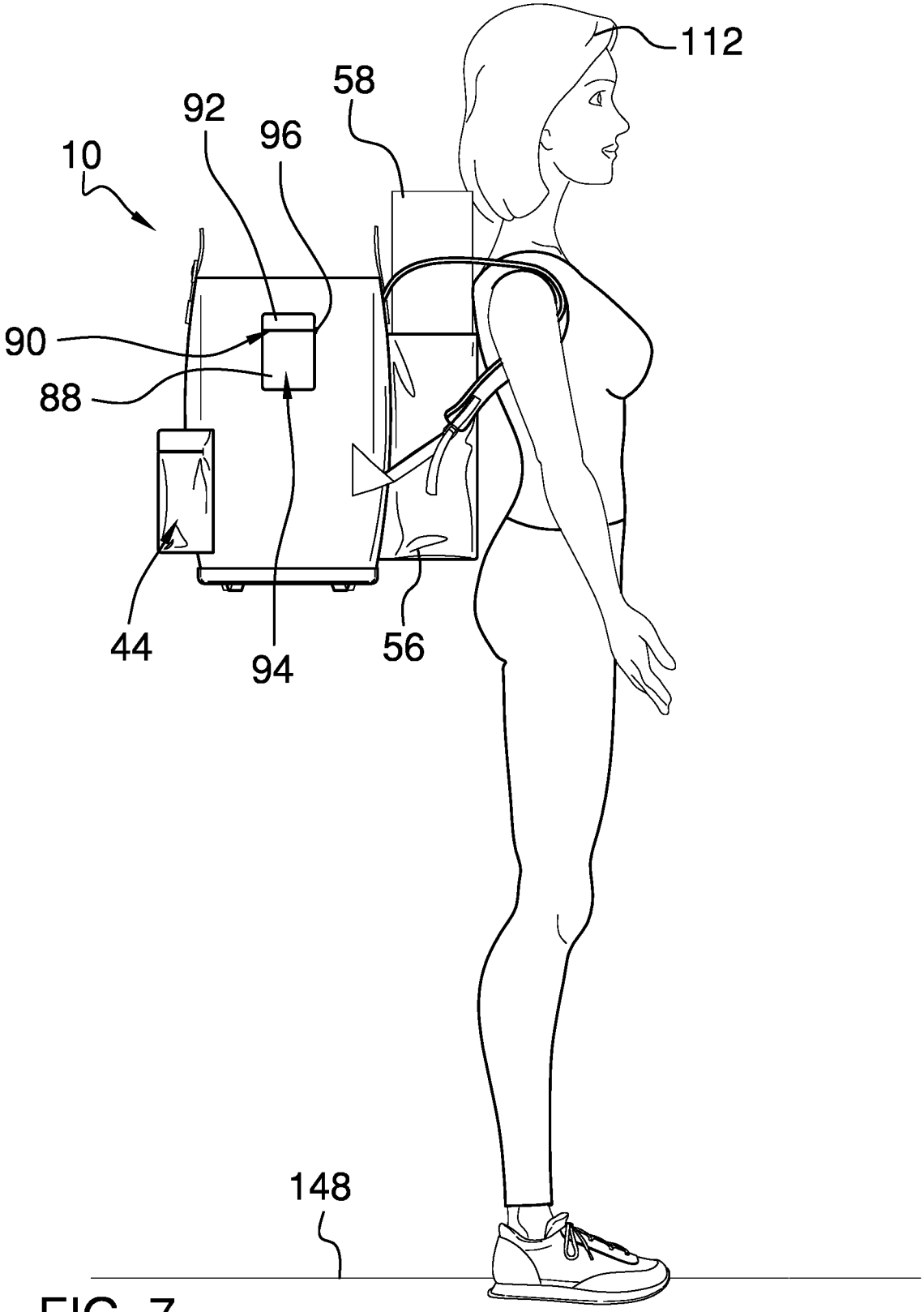
FIG. 7 is an in-use view of an embodiment of the disclosure.
Figure 8:
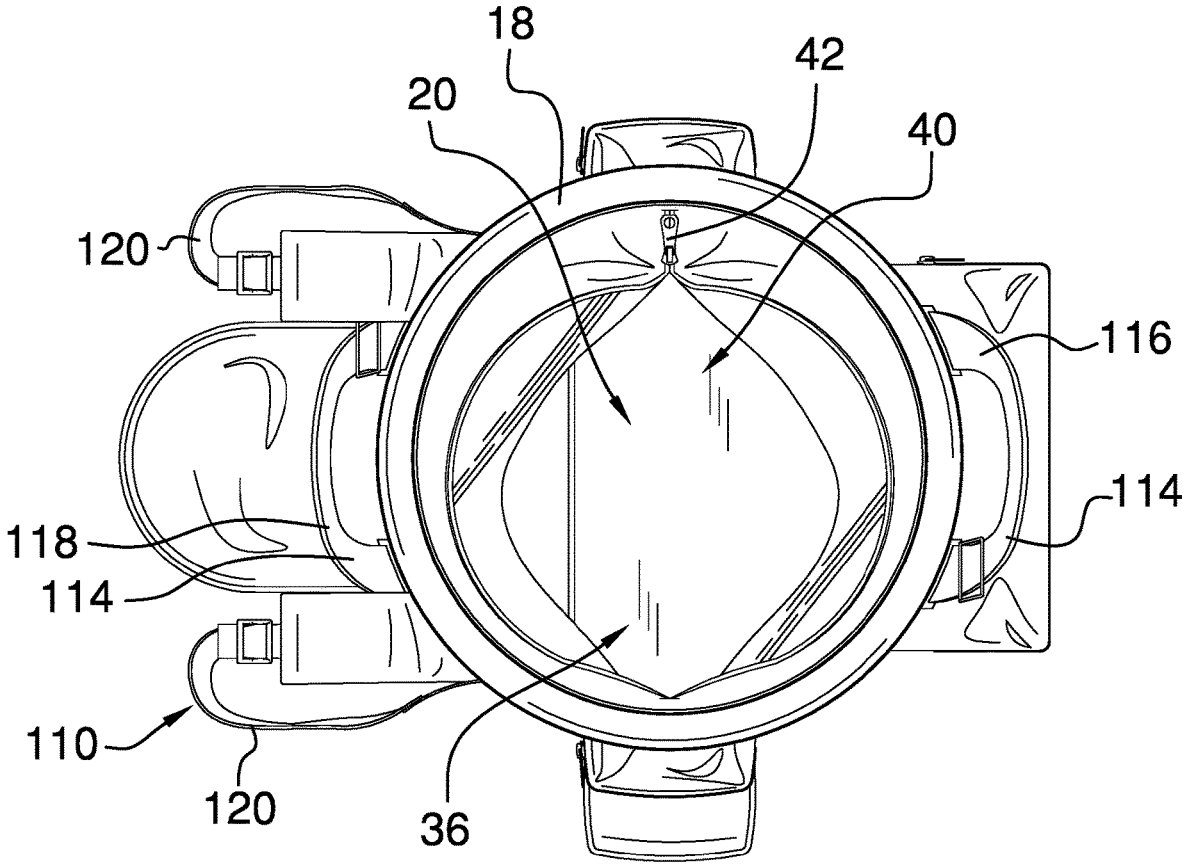
FIG. 8 is a top view of an embodiment of the disclosure.

In use, the gym bag device 10 can be used to conveniently carry all items the user 112 needs while exercising at the gym. The headphones 52 can be carried in the front pocket 44. The rolled-up yoga mat 58 can be carried in the back pocket 56, sitting comfortably against the back of the user 112 as shown in FIG. 7. The cell phone or other personal electronic device 78 can be carried in either the cell phone pocket 70 or the accessory pocket 88. The water bottle 86 can be carried in the water bottle pocket 82. Additional items, such as a change of clothes, keys, a wallet, or towels, can be carried within the interior space 36 and organized using the plurality of inner pockets 98. The plurality of feet 108 extending downwardly from the plate 104 can ensure the gym bag device 10 sits securely and stably on the ground surface 148 when the user 112 is not carrying the gym bag device 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A gym bag assembly comprising:

a container having a base side and a peripheral side being coupled to and extending upwardly from the base side, the peripheral side having an upper edge, the upper edge defining an upper opening extending into the container, the peripheral side having a front side, a back side, and a pair of lateral sides being coupled to and extending between the front side and the back side;

a plate being coupled to an exterior surface of the base side of the container, the plate comprising a rigid material being configured to retain the base side in a circular shape;

a front pocket being coupled to the front side of the container;

a back pocket being coupled to the back side of the container, the back pocket being rounded wherein the back pocket is configured to hold a rolled-up yoga mat;

a plurality of side pockets being coupled to the pair of lateral sides of the container;

a plurality of straps being coupled to the container, each strap of the plurality of straps being configured to facilitate a user in carrying the container, the plurality of straps further comprising a pair of handle straps being coupled to and extending upwardly from the peripheral side of the container, and a carrying strap being removably couplable to the pair of handle straps, the carrying strap further comprising:

a first strap end, a first end coupler being coupled to the first strap end, the first end coupler releasably attaching the first strap end to one of the pair of handle straps, a second strap end, and a second end coupler being coupled to the second strap end, the second end coupler releasably attaching the second strap end to one of the pair of handle straps;

a liner having a top wall, a bottom wall and a perimeter wall extending upwardly from the bottom wall to the top wall to define an interior space of the liner, the liner being coupled to and coextensive with an inside surface of the container, the top wall extending across the upper opening extending into the container, the top wall being openable to facilitate access into the interior space of the liner through the upper opening extending into the container, the perimeter wall of the liner abutting and being coextensive with the peripheral side of the container;

a slit extending through the top wall of the liner, the slit being openable to facilitate access to the interior space;

a plurality of inner pockets being coupled to the liner, the plurality of inner pockets being positioned in the interior space;

a front pocket opening extending into the front pocket;

a front pocket lid being coupled to the front side of the container, the front pocket lid being positioned adjacent to the front pocket opening, the front pocket lid being releasably couplable to the front pocket for selectively closing the front pocket opening, the front pocket and the front pocket lid defining a front storage space wherein the front pocket is configured for storing a pair of over-the-ear headphones.

2. The gym bag assembly of claim 1, the back pocket further comprising:

a bottom panel being coupled to the back side of the container proximate to the base side;

a side panel being coupled to and extending upwardly from the bottom panel, the side panel having a free edge being spaced from the bottom panel, the free edge being positioned proximate to the upper edge of the peripheral side of the container, the free edge defining a back pocket opening extending into the back pocket, the back pocket opening being configured to receive the rolled-up yoga mat.

3. The gym bag assembly of claim 1, the plurality of side pockets further comprising:

a cell phone pocket being coupled to a one of the pair of lateral sides, the cell phone pocket being positioned proximate to the upper edge of the peripheral side, the cell phone pocket having a cell phone pocket opening extending into the cell phone pocket;

a cell phone pocket lid being coupled to the one of the pair of lateral sides, the cell phone pocket lid being positioned adjacent to the cell phone pocket opening, the cell phone pocket lid being releasably couplable to the cell phone pocket for selectively closing the cell phone pocket opening, the cell phone pocket and the cell phone pocket lid defining a cell phone storage space wherein the cell phone pocket is configured for storing a personal electronic device.

4. The gym bag assembly of claim 1, the plurality of side pockets further comprising a water bottle pocket being coupled to a one of the pair of lateral sides, the water bottle pocket having a water bottle pocket opening extending into the water bottle pocket.

5. The gym bag assembly of claim 1, the plurality of side pockets further comprising an accessory pocket being coupled to a one of the pair of lateral sides, the accessory pocket having an accessory pocket opening extending into the accessory pocket.

6. The gym bag assembly of claim 5, further comprising an accessory pocket lid being coupled to the one of the pair of lateral sides, the accessory pocket lid being positioned adjacent to the accessory pocket opening, the accessory pocket lid being releasably couplable to the accessory pocket for selectively closing the accessory pocket opening, the accessory pocket and the accessory pocket lid defining an accessory pocket storage space wherein the accessory pocket is configured for storing a personal electronic device.

7. The gym bag assembly of claim 1, further comprising a plurality of feet being attached to the plate, the plurality of feet extending downwardly from the plate wherein the plurality of feet is configured to support the container over a ground surface when the plurality of feet is resting on the ground surface.

8. The gym bag assembly of claim 1, the first end coupler further comprising:

a primary attachment piece being attached to the first strap end; and a secondary attachment piece being removably engageable with the primary attachment piece, the secondary attachment piece being attached to the carrying strap proximate to the primary attachment piece, the secondary attachment piece being spaced from the primary attachment piece wherein the first strap end is configured to fold over the carrying strap to form a first loop for engaging the one of the pair of handle straps.

9. The gym bag assembly of claim 1, the second end coupler further comprising:

an outer attachment piece being attached to the second strap end; and an inner attachment piece being removably engageable with the outer attachment piece, the inner attachment piece being attached to the carrying strap proximate to the outer attachment piece, the inner attachment piece being spaced from the outer attachment piece wherein the second strap end is configured to fold over the carrying strap to form a second loop for engaging the one of the pair of handle straps.

10. The gym bag assembly of claim 1, the plurality of straps further comprising a pair of shoulder straps being coupled to the back side of the container.

11. A gym bag assembly comprising:

a container having a base side and a peripheral side being coupled to and extending upwardly from the base side, the peripheral side having an upper edge, the upper edge defining an upper opening extending into the container, the peripheral side having a front side, a back side, and a pair of lateral sides being coupled to and extending between the front side and the back side, the base side having a circular shape wherein the container is cylindrical;

a liner having a top wall, a bottom wall and a perimeter wall extending upwardly from a perimeter edge of the bottom wall to the top wall to define an interior space of the liner, the liner being coupled to and coextensive with an inside surface of the container, the liner comprising a waterproof material wherein the liner is configured to inhibit the inside surface of the container from absorbing fluids, the bottom wall abutting and being coextensive with the base side of the container, the bottom wall being coextensive with an entirety of the base side of the container, the top wall extending across the upper opening extending into the container, the top wall being openable to facilitate access into the interior space of the liner through the upper opening extending into the container, the perimeter wall of the liner abutting and being coextensive with the peripheral side of the container, the perimeter wall extending upwardly relative to the bottom wall wherein the perimeter wall of the liner covers a portion of the peripheral side of the container extending upwardly from the base side;

a slit extending through the top wall of the liner, the slit being openable to facilitate access to the interior space, the slit extending between the pair of lateral sides of the container, the slit being spaced equidistantly from each of the front side and the back side of the container;

a slit fastener being coupled to the slit for selectively opening and closing the slit, the slit fastener comprising a zipper;

a front pocket being coupled to and extending outwardly from the front side of the container, the front pocket being positioned proximate to the base side of the container, the front pocket having a front pocket opening extending into the front pocket;

a front pocket lid being coupled to the front side of the container, the front pocket lid being positioned adjacent to the front pocket opening, the front pocket lid being releasably couplable to the front pocket for selectively closing the front pocket opening, the front pocket and the front pocket lid defining a front storage space wherein the front pocket is configured for storing a pair of headphones wherein the pair of headphones comprises over-the-ear headphones;

a front pocket fastener releasably coupling the front pocket lid to the front pocket for selectively opening and closing the front pocket opening, the front pocket fastener comprising a zipper;

a back pocket being coupled to and extending outwardly from the back side of the container, the back pocket being rounded wherein the back pocket is configured to hold a rolled-up yoga mat, the back pocket further comprising:

a bottom panel being coupled to the back side of the container proximate to the base side, the bottom panel extending outwardly from the back side of the container;

a side panel being coupled to and extending upwardly from the bottom panel, the side panel having a free edge being spaced from the bottom panel, the free edge being positioned proximate to the upper edge of the peripheral side of the container, the free edge defining a back pocket opening extending into the back pocket, the back pocket opening being configured to receive the rolled-up yoga mat;

a plurality of side pockets being coupled to and extending outwardly from the pair of lateral sides of the container, the plurality of side pockets further comprising:

a cell phone pocket being coupled to and extending outwardly from a first one of the pair of lateral sides, the cell phone pocket being positioned proximate to the upper edge of the peripheral side, the cell phone pocket having a cell phone pocket opening extending into the cell phone pocket;

a cell phone pocket lid being coupled to the first one of the pair of lateral sides, the cell phone pocket lid being positioned adjacent to the cell phone pocket opening, the cell phone pocket lid being releasably couplable to the cell phone pocket for selectively closing the cell phone pocket opening, the cell phone pocket and the cell phone pocket lid defining a cell phone storage space wherein the cell phone pocket is configured for storing a personal electronic device;

a cell phone pocket fastener releasably coupling the cell phone pocket lid to the cell phone pocket for selectively opening and closing the cell phone pocket opening, the cell phone pocket fastener comprising a zipper;

a water bottle pocket being coupled to and extending outwardly from the first one of the pair of lateral sides, the water bottle pocket having a height exceeding a height of the cell phone pocket, the water bottle pocket having a water bottle pocket opening being positioned beneath the cell phone pocket, the water bottle pocket opening being round wherein the water bottle pocket is configured for storing a water bottle;

an accessory pocket being coupled to and extending outwardly from a second one of the pair of lateral sides, the accessory pocket having a accessory pocket opening extending into the accessory pocket, the accessory pocket being aligned with the cell phone pocket;

an accessory pocket lid being coupled to the second one of the pair of lateral sides, the accessory pocket lid being positioned adjacent to the accessory pocket opening, the accessory pocket lid being releasably couplable to the accessory pocket for selectively closing the accessory pocket opening, the accessory pocket and the accessory pocket lid defining a accessory pocket storage space wherein the accessory pocket is configured for storing the personal electronic device;

an accessory pocket fastener releasably coupling the accessory pocket lid to the accessory pocket for selectively opening and closing the accessory pocket opening, the accessory pocket fastener comprising a zipper;

a plurality of inner pockets being coupled to the liner, the plurality of inner pockets being positioned in the interior space of the liner, the plurality of inner pockets extending outwardly into the interior space of the liner, the plurality of inner pockets further comprising:

a lower pocket being coupled to the bottom wall of the liner, the lower pocket extending upwardly from the bottom wall of the liner, the lower pocket being positioned adjacent to the back side of the container;

an upper pocket being coupled to the perimeter wall of the liner, the upper pocket extending outwardly from the perimeter wall of the liner, the upper pocket being aligned with the lower pocket along the back side of the container, the upper pocket being spaced from the lower pocket;

wherein the lower pocket has a volume exceeding a volume of the upper pocket;

a plate being coupled to an exterior surface of the base side of the container, the plate comprising a rigid material being configured to conform the base side to the circular shape, the rigid material comprising rubber;

a plurality of feet being attached to the plate, the plurality of feet extending downwardly from the plate wherein the plurality of feet is configured to support the container over a ground surface when the plurality of feet is resting on the ground surface;

a plurality of straps being coupled to the container, each strap of the plurality of straps being configured to facilitate a user in carrying the container, the plurality of straps further comprising:

a pair of handle straps being coupled to and extending upwardly from the peripheral side of the container, the pair of handle straps being positioned on opposing lateral sides of the peripheral side, the pair of handle straps being positioned adjacent to the upper edge of the peripheral side, the pair of handle straps further comprising:

a first handle being coupled to the front side of the container;

a second handle being coupled to the back side of the container, the second handle being aligned with the first handle;

wherein each of the pair of handle straps has an adjustable length;

a carrying strap being removably couplable to the pair of handle straps, the carrying strap extending over the upper opening extending into the container when the carrying strap is coupled to the pair of handle straps, the carrying strap further comprising:

a first strap end;

a first end coupler being coupled to the first strap end, the first end coupler releasably attaching the first strap end to one of the pair of handle straps, the first end coupler further comprising:

a primary attachment piece being attached to the first strap end;

a secondary attachment piece being removably engageable with the primary attachment piece, the secondary attachment piece being attached to the carrying strap proximate to the primary attachment piece, the secondary attachment piece being spaced from the primary attachment piece wherein the first strap end is configured to fold over the carrying strap to form a first loop for engaging the one of the pair of handle straps;

wherein each of the primary attachment piece and the secondary attachment piece comprises a hook and loop material;

a second strap end;

a second end coupler being coupled to the second strap end, the second end coupler releasably attaching the second strap end to one of the pair of handle straps, the second end coupler further comprising:

an outer attachment piece being attached to the second strap end;

an inner attachment piece being removably engageable with the outer attachment piece, the inner attachment piece being attached to the carrying strap proximate to the outer attachment piece, the inner attachment piece being spaced from the outer attachment piece wherein the second strap end is configured to fold over the carrying strap to form a second loop for engaging the one of the pair of handle straps;

wherein each of the inner attachment piece and the outer attachment piece comprises a hook and loop material;

a pair of shoulder straps being coupled to the back side of the container, the back pocket being positioned between the pair of shoulder straps, each of the pair of shoulder straps having an adjustable length;

a plurality of decorative indicia a front logo being positioned on the front side of the peripheral side of the container above the front pocket; and a back logo being positioned on the back pocket adjacent to the free edge of the side panel.

* * * * *